US011372375B2

(12) United States Patent
Hundzinger et al.

(10) Patent No.: US 11,372,375 B2
(45) Date of Patent: Jun. 28, 2022

(54) MEASURING DEVICE FOR A MECHANICAL WATCH

(71) Applicant: The Swatch Group Research and Development Ltd, Marin (CH)

(72) Inventors: Alexandre Hundzinger, Neuchâtel (CH); Thierry Scordilis, Cormondrèche (CH); Yoann Mosteiro Vazquez, Montmagny (CH); José Lehmann, Bevaix (CH); Giuseppe Zamuner, Chavannes-Renens (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 17/030,954

(22) Filed: Sep. 24, 2020

(65) Prior Publication Data

US 2021/0116870 A1 Apr. 22, 2021

(30) Foreign Application Priority Data

Oct. 21, 2019 (EP) ..... 19204404

(51) Int. Cl.
*G04D 7/00* (2006.01)

(52) U.S. Cl.
CPC ..... *G04D 7/006* (2013.01)

(58) Field of Classification Search
CPC ..... G04D 7/006; G04D 7/125
See application file for complete search history.

(56) References Cited

U.S. PATENT DOCUMENTS 3,690,144 A * 9/1972 Bonny ..... H04R 1/46 73/1.51
3,802,251 A * 4/1974 Durr ..... G04D 7/007 73/49.3
3,946,592 A 5/1976 Ichikawa et al.

FOREIGN PATENT DOCUMENTS

| | | | | |
|---|---|---|---|---|
| CH | 708 924 | A2 | 6/2015 | |
| CN | 205484197 | U | 8/2016 | |
| EP | 3611575 | A1 * | 2/2020 | ..... G06N 3/04 |
| FR | 2.059.696 | A1 | 6/1971 | |
| WO | 2015/082483 | A2 | 6/2015 | |

OTHER PUBLICATIONS

European Search Report for EP 19 20 4404, dated Apr. 14, 2020.
Office Action dated Sep. 15, 2021 in Chinese Application No. 202011131402.7.

* cited by examiner

*Primary Examiner* — Paul M. West
*Assistant Examiner* — Mark A Shabman
(74) *Attorney, Agent, or Firm* — Sughrue Mion, PLLC

(57) ABSTRACT

A portable device, and related method, that allows the values of one or more parameters characterising the operation of a mechanical watch to be measured. The device is provided with a contact microphone including a contact piece and a piezoelectric element. The contact piece is brought into physical contact with the case of a watch during a measurement period. The device further includes a power source, such as a rechargeable or replaceable battery, a microprocessor, a memory, and a screen for displaying the values measured, preferably a touch-sensitive screen. Preferably, the dimensions of the device are of a same order of magnitude as the case of a wristwatch. The device may have the shape of a horological eyeglass.

11 Claims, 3 Drawing Sheets

Fig. 1a
Fig. 1b
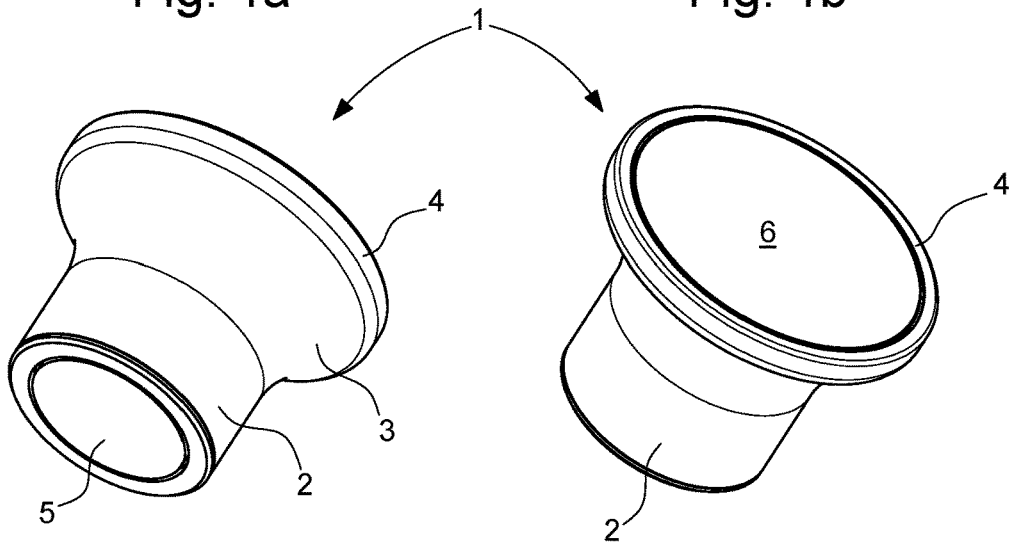
Fig. 2
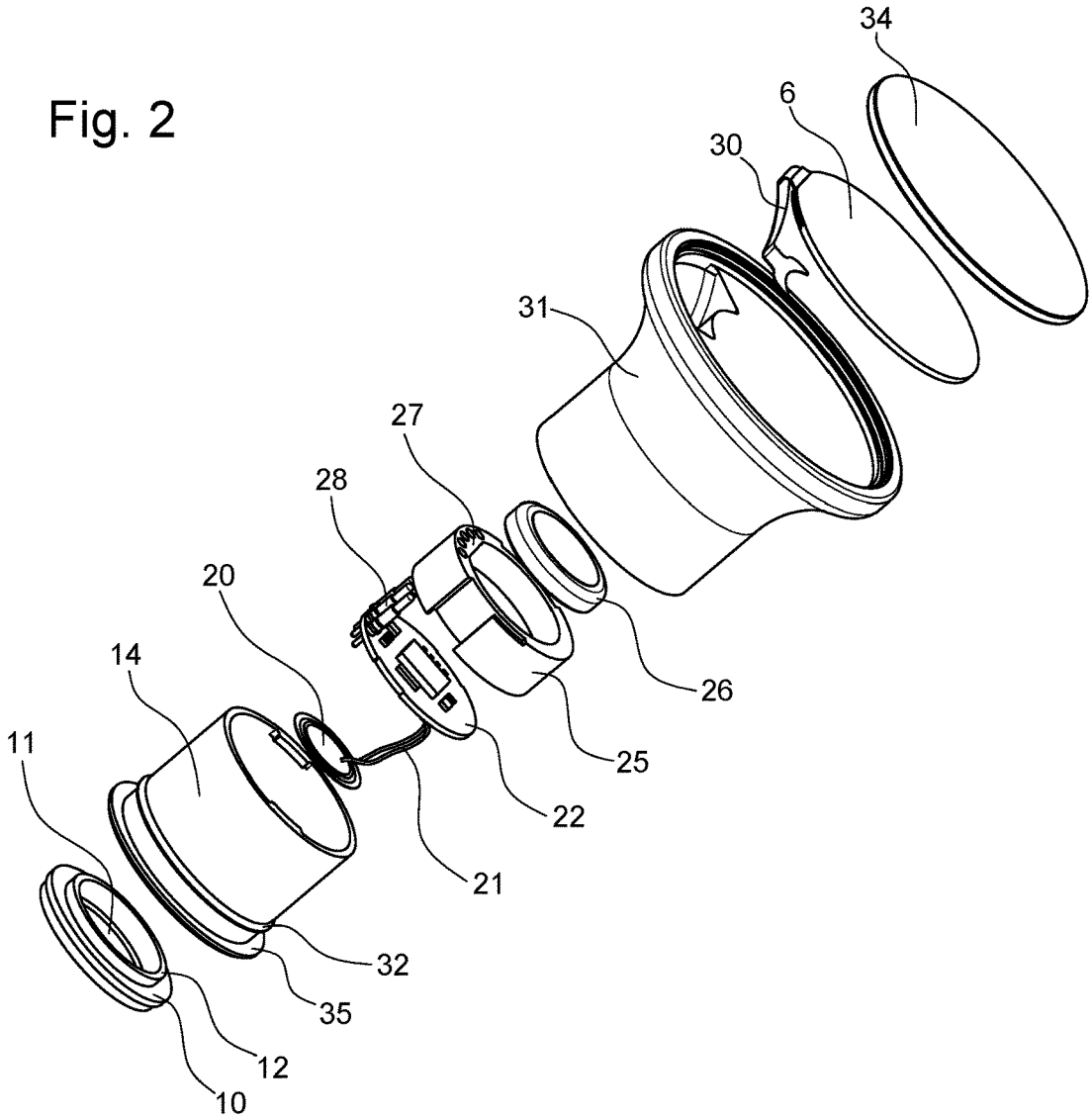

MEASURING DEVICE FOR A MECHANICAL WATCH

CROSS REFERENCE TO RELATED APPLICATIONS

This application claims priority to European Patent Application No. 19204404.8 filed Oct. 21, 2019, the entire contents of which are incorporated herein by reference.

TECHNICAL FIELD OF THE INVENTION

The present invention relates to the field of mechanical watches with manual or automatic winding, and more particularly to devices for testing the mechanical movement of this type of watch.

PRIOR ART

Tests are known for determining the regularity of running, as well as other parameters characteristic of a mechanical watch movement. The measurements applied consist of optical and/or acoustic measurements of the impulses generated by the mechanical oscillator of the movement of the watch. The acoustic measurements known to date often use expensive microphones which make this solution not very cost-effective. The equipment used to implement the optical methods is relatively complex and furthermore expensive.

In general, the devices known to date for testing a mechanical watch were developed for a laboratory environment. These devices are not aimed for use by the individual wearing the watch. A test device that is compact and easy to use is not commercially available at this time.

SUMMARY OF THE INVENTION

The present invention aims to provide a solution to the aforementioned problems. This purpose is achieved by a device and by the methods according to the accompanying claims.

The invention relates to a portable device that allows the values of one or more parameters characterising the operation of a mechanical watch to be measured. The device is provided with a contact microphone comprising a contact piece and, for example, a piezoelectric element. The device is held in the hand and the contact piece is brought into physical contact with the case of a watch during a measurement period. The device further comprises a power source, such as a replaceable or rechargeable battery, a microprocessor, a memory, and a screen for displaying the values measured, preferably a touch-sensitive screen. Preferably, the dimensions of the device are of the same order of magnitude as the case of a wristwatch. According to one specific embodiment, the device has the shape of a horological eyeglass. The invention further relates to a measuring method using the device of the invention. The device is easy to use and allows the wearer to test his/her own watch.

Other features and advantages of the present invention will appear upon reading the following description given of preferred embodiments, provided as non-limiting examples with reference to the accompanying drawings.

BRIEF DESCRIPTION OF THE FIGURES

The invention will be described in more detail hereinafter using the accompanying drawings, given by way of examples that are in no way limiting, wherein:

FIGS. 1*a* and 1*b* show two 3D views of a device according to one embodiment of the invention, FIG. 2 shows an exploded view of the device in FIG. 1.

DETAILED DESCRIPTION OF THE INVENTION

Figure 3:
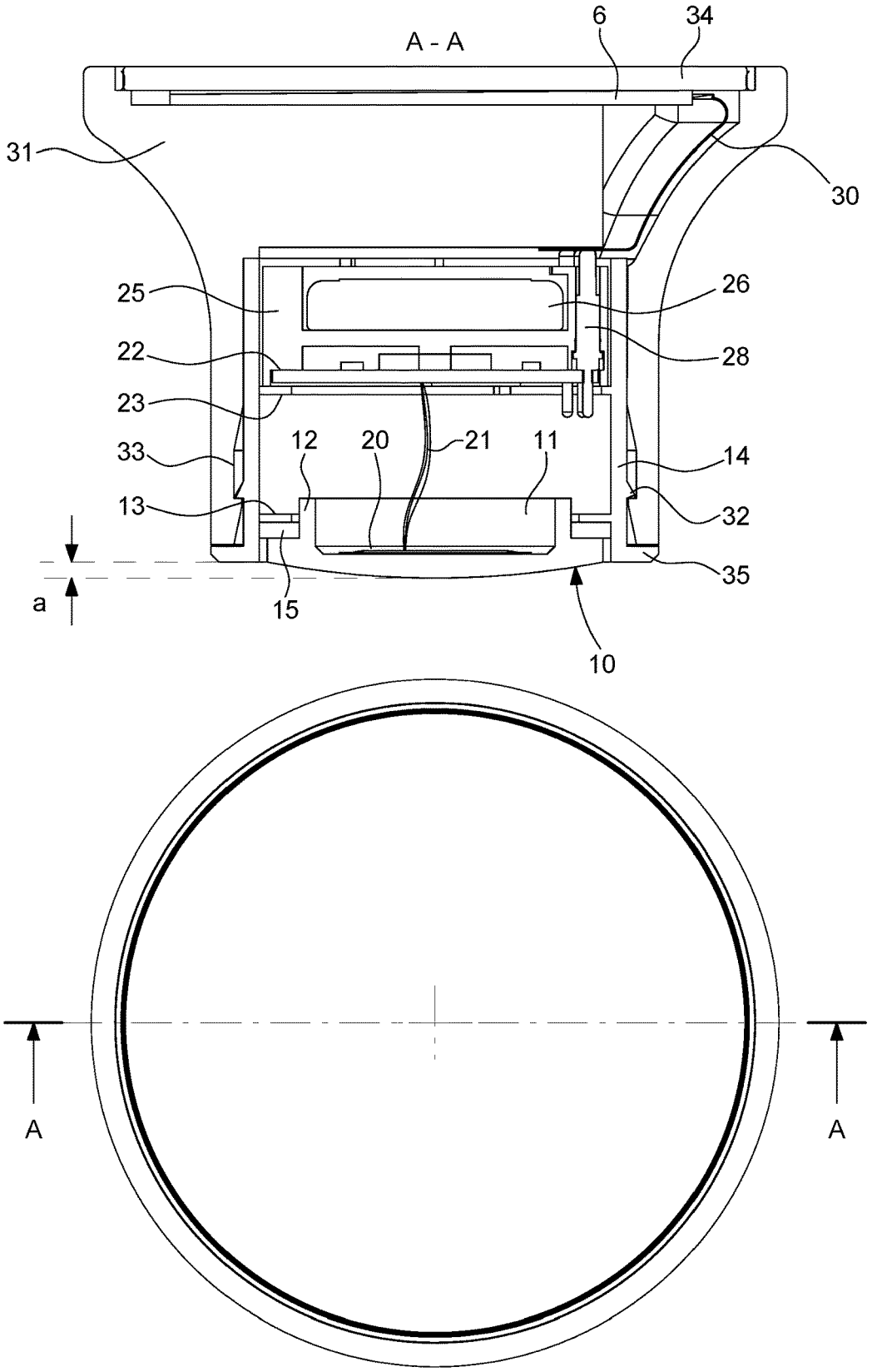
FIG. 3 shows a plan and sectional view of the device in FIGS. 1 and 2.

The device 1 shown in FIGS. 1*a* and 1*b* has the external shape and the dimensions of a horological eyeglass, including a cylindrical portion 2 and a portion having a conical or curved section 3, which widens from the cylindrical portion 2 in the direction of a section 4 that is wider than the cylindrical section 2. The invention is not limited to this shape, since the functionality of the device is far different from that of a horological eyeglass. A curved surface 5 is provided at the end of the cylindrical portion 2. The surface 5 acts as a contact surface between the device and the case of a watch to be tested. The curvature of the contact surface 5 and the hardness of the material of the surface are such that the contact area between the surface 5 and the case is essentially limited to a point, measured relative to the average dimensions of the watch. A digital screen 6, preferably a touch-sensitive screen, is integrated into the section 4 in order to display the data measured and to receive instructions from the user.

FIGS. 2 and 3 show that the contact surface 5 is the external surface of a round piece 10, hereafter referred to as the contact piece. In order to produce the contact at a point, the contact piece 10 is preferably made of a hard metal or of a hard synthetic material, for example having a hardness of at least 100 Vickers. On the other side of the external surface 5, the contact piece 10 comprises a cylindrical cavity 11 surrounded by a hollow and cylindrical elevation 12, having a diameter that is less than the diameter of the contact surface 5. The contact piece 10 is attached to an inner flange 13 of a cylindrical frame 14, preferably made of metal, the cylindrical elevation 12 passing through the opening defined by the flange 13. A washer 15 made of a compressible material, for example made of a shock-absorbing foam, is mounted between the contact piece 10 and the flange 13. The piece 10, the washer 15 and the flange 13 are rigidly connected to one another, for example by using an adhesive foam for the washer 15. When the device 1 is not in use, the apex of the curved surface 5 projects from the lower plane of the frame 14 by an offset 'a' shown in FIG. 3.

A piezoelectric element 20 is fastened to the bottom of the cavity 11 of the contact piece 10 such that the assembly formed by the piece 10 and the piezoelectric element 20 constitutes a contact microphone. The piezoelectric element 20 is connected by an electric wire 21 to a PCB (printed circuit board) 22 fastened to a second inner flange 23 of the frame 14. The PCB 22 is provided with electronic components, configured so as to process and analyse the signals generated by the microphone, and described in more detail hereinbelow.

A battery carrier 25 made of plastic is inserted in a fixed manner inside the frame 14, above the PCB 22. The battery carrier 25 comprises a housing capable of receiving a replaceable battery 26, for example a standard battery of the CR1632 type. According to other embodiments, the device is provided with a rechargeable battery. Conductors (not shown) are integrated into the battery carrier 25 so as to connect the battery 26 to the PCB 22 in order to power the components of the PCB. The battery carrier 25 is provided with a number of openings 27 for passing spring-loaded pins 28 which will create a connection between the PCB 22 and the digital screen 6 of the device. The screen 6 is provided with a connector 30 which will be in contact with the spring-loaded pins 28.

An outer eyeglass-shaped casing 31 is mounted around the frame 14 and is clipped onto said frame by means of a rib 32 on the outer surface of the frame 14. The rib 32 enters a recess 33 inside the outer casing 31 when the latter is placed around the frame 14 and pushed downwards. The outer casing 31 is made of a synthetic material, for example silicone, which allows for sufficient deformation to produce the connection by clipping. Instead of this type of connection, other means for reversibly attaching the casing 31 to the frame 14 are possible within the scope of the invention. The top section of the casing 31 includes a protective glass 34 for the screen 6, allowing the instructions of the user to be transmitted in the case of a touch-sensitive screen. On the other side, the casing 31 comes into contact with an outer flange 35 of the frame 14.

Figure 4:
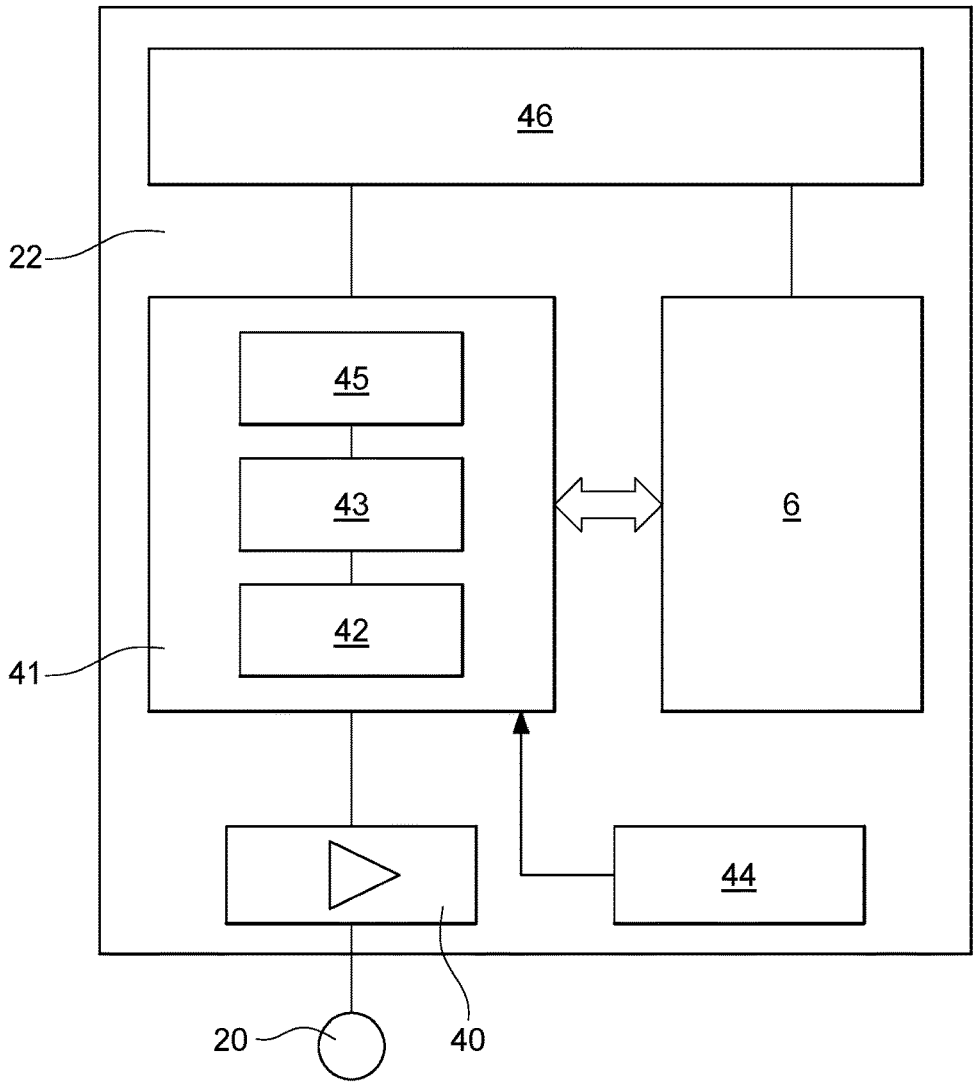
FIG. 4 shows a diagram of the components mounted on the PCB inside the device according to one embodiment of the invention.

In order to use the device 1, a user holds the device in his/her hand and positions it with the contact surface 5 in physical contact with a watch case in the wound state, while slightly pressing down on the device. The offset 'a' allows this pressure to compress the resilient washer 15, so as to ensure an adequate contact force between the device 1 and the watch case. The device is held in this position using a fastening system for a measurement period of about ten seconds for example. The user can activate the device via the touch-sensitive screen 6 or the device can be configured to be automatically activated as soon as it is positioned and pressed against a surface of the watch. A measurement period is thus started, during which the microphone measures the acoustic noises generated by the mechanical movement of the watch. In a manner known per se, these noises consist of an alternating sequence of two types of impulses of different character, often referred to as 'tick' and 'tock'. Analysing the impulses allows parameters linked to the operation of the movement to be calculated, such as the running state and the beat. These analyses and calculations are carried out by the components mounted on the PCB. Several configurations are possible for these components within the scope of the invention. One example of a configuration is shown in FIG. 4.

The signal generated by the piezoelectric element 20 passes via an amplification stage 40 to a processing unit 41 which includes an analogue-to-digital converter (ADC) 42, a microprocessor 43 clocked by an accurate oscillator 44 (preferably of the TOXO—Temperature Compensated Crystal Oscillator type) and a memory 45. The processing unit 41 is connected to a power management unit 46 connected to the battery, and to the digital screen 6. The microprocessor 43 is configured so as to calculate the values of the parameters, record the values in the memory 45, and display the values on the screen 6.

Figure 5:
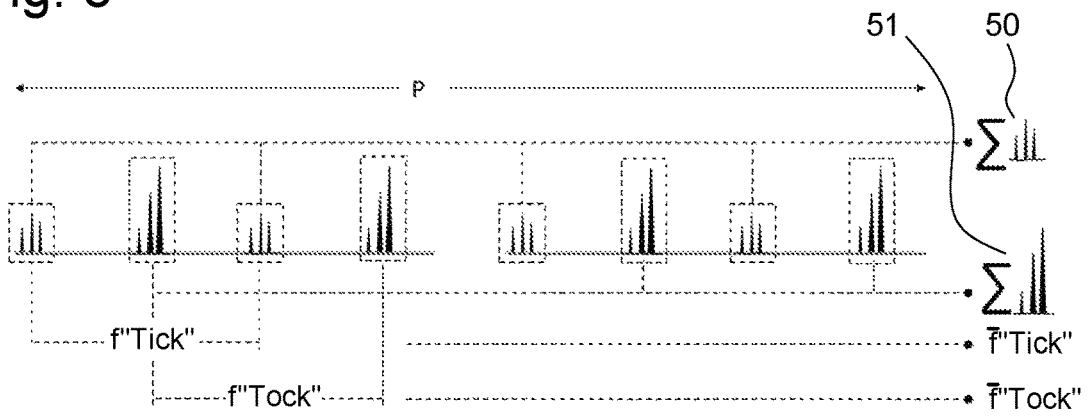
FIG. 5 shows a typical signal detected by the microphone inside the device of the invention, when the device is held in contact with a watch case.

FIG. 5 shows a diagrammatic illustration of the signal measured by the microphone during a measurement period P. The 'tick' and 'tock' impulses are shown. In a manner known per se, each impulse consists of a sequence of peaks linked to specific phenomena that characterise the escapement inside the movement of the watch. As is also well known in the prior art, analysing impulses allows the value of a number of digital parameters characterising the operation of the movement to be calculated, such as the frequency of the 'ticks' and 'tocks', the running state (gain or loss of the movement relative to a reference oscillation obtained by the oscillator 44), the beat (offset between the tick and tock frequencies), the amplitude of the movements (the angle between the position of equilibrium and the return point of the balance) and the type of escapement (Swiss lever escapement or coaxial escapement).

According to one possible mode of operation of the device of the invention, the values of one or more of these parameters are recorded at the end of each measurement period, for example the values of the five parameters identified hereinabove (frequency, running state, etc.). The values can be identified in an instantaneous manner at the end of the measurement period P. For certain parameters, the values can also be calculated based on the signals detected during the entire period. For example, and as shown in FIG. 5, the frequencies can be calculated as averages $\bar{f}_{tick}$ and $\bar{f}_{tock}$ of the instantaneous frequencies $f_{tick}$ and $f_{tock}$ determined based on the time between two impulses of the same type (tick or tock).

One specific mode of operation, also shown in FIG. 5, includes calculating the value of the amplitude of the movement, based on the sum 50 of the 'tick' impulses and the sum 51 of the 'tock' impulses detected by the microphone over the full duration of the period P. It has been seen that the sum of the impulses allows the individual peaks forming a part of each of the impulses to be better identified, and thus improves the accuracy of the calculation of the amplitude of the movement.

The invention is not limited to the outer shape shown in the figures. In general, the device is portable and compact, preferably having dimensions of the same order of magnitude as the case of a wristwatch. The device is easy to use and is designed to be used by the individual wearing the watch, who can use it to periodically check the operation of his/her watch. The device can thus serve as a diagnostics device capable of being used by the individual wearing a watch, in order to gather operating data and which will allow a specialist to detect defects.

The invention claimed is:

1. A portable device for testing a mechanical watch, configured so as to be held in the hand and kept in physical contact with the case of a mechanical watch, wherein the device comprises:

a contact microphone comprising a contact piece and a piezoelectric element, for detecting the noises of the impulses generated by the movement of the watch, when the contact piece is held in physical contact with the case of the watch, a microprocessor configured so as to calculate, based on the signal generated by the microphone, the values of one or more parameters characterizing the operation of the movement of the watch, in addition to a memory for recording said values, a screen configured so as to display at least said values, and an electrical power source for powering at least the microprocessor, the memory and the screen, wherein said device includes an outer casing, a frame inside the outer casing, and wherein the contact piece has a curved external contact surface configured so as to be placed in contact with the watch case, the contact piece being attached to the frame, such that the curved surface projects at least partially from the outer casing when the device is not in use, wherein the entire external contact surface has a curved surface, wherein the contact piece comprises an elevation surrounding a cavity into which the piezoelectric element is provided, wherein the contact piece is attached a first inner flange of the frame though a compressible washer, wherein the microprocessor is provided on a circuit board attached to a second inner flange of the frame, wherein a hollow space is provided between the contact piece and the circuit board, and wherein the curved surface, which projects at least partially from the outer casing, is configured to allow the compressible washer to compress when a contact force between the portable device and the watch is applied.

2. The device according to claim 1, wherein the microprocessor and the memory are mounted on the circuit board.

3. The device according to claim 1, wherein the frame and at least one portion of the outer casing have a round cylindrical shape, the contact piece being a round piece that projects from the casing on one side of said casing, and wherein the screen is mounted on another side of said casing.

4. The device according to claim 3, wherein the outer casing has the shape of a horological eyeglass, comprising a cylindrical portion and a portion which widens in the direction of a section that is wider than the cylindrical portion, and wherein the screen is mounted in said wide section.

5. The device according to claim 1, wherein the screen is a touch-sensitive screen.

6. A method for testing a mechanical watch in the wound state using a device according to claim 1, the method comprising:

acquiring the signal generated by the microphone during a measurement period during which the device is held in contact with the case of the watch, the signal representing a sequence of 'tick' and 'tock' impulses generated by the movement of the watch, recording, at the end of the measurement period, the value of at least one parameter characterizing the operation of the movement of the watch, and repeating the previous steps at determined intervals.

7. The method according to claim 6, wherein the values recorded comprise one or more of the following values:

the frequency of the 'tick' impulses and the frequency of the 'tock' impulses, the running state, the beat, the amplitude of the movement, and the type of movement.

8. The method according to claim 7, further comprising the recording of the amplitude of the movement, and wherein the amplitude of the movement is calculated is based on the sum of the signals linked to the 'tick' impulses and on the sum of the signals linked to the 'tock' impulses, during the measurement period, wherein the 'tick' impulses are different from the 'tock' impulses.

9. The device according to claim 1, wherein the cavity is a cylindrical cavity and the elevation is hollow and cylindrical.

10. The device according to claim 1, wherein the piezoelectric element is provided at the bottom of the cavity.

11. The device according to claim 1, wherein the frame is a cylindrical frame.

* * * * *